US008777142B2

(12) United States Patent
Gronholz

(10) Patent No.: US 8,777,142 B2
(45) Date of Patent: Jul. 15, 2014

(54) DEVICE FOR MECHANICAL SEPARATION OF MATERIAL CONGLOMERATES FROM MATERIALS OF DIFFERENT DENSITY AND/OR CONSISTENCY

(75) Inventor: Claus Gronholz, Ammersbek (DE)

(73) Assignee: Tartech eco industries AG, Berlin (DE)

( * ) Notice: Subject to any disclaimer, the term of this patent is extended or adjusted under 35 U.S.C. 154(b) by 243 days.

(21) Appl. No.: 13/486,215

(22) Filed: Jun. 1, 2012

(65) Prior Publication Data

US 2012/0325949 A1 Dec. 27, 2012

(30) Foreign Application Priority Data

Jun. 1, 2011 (DE) ..... 10 2011 050 789

(51) Int. Cl.
*B02C 13/00* (2006.01)
*B02C 1/10* (2006.01)

(52) U.S. Cl.
USPC ..... 241/188.1; 241/275

(58) Field of Classification Search
None
See application file for complete search history.

(56) References Cited

U.S. PATENT DOCUMENTS 1,758,010 A * 5/1930 Pettinos ..... 241/154
1,788,683 A * 1/1931 Bramley-Moore ..... 241/43
1,911,193 A * 5/1933 Hill ..... 241/154
1,927,277 A * 9/1933 Canary ..... 241/154
1,967,323 A * 7/1934 Pettibone ..... 241/154
2,838,246 A * 6/1958 Adorno et al. ..... 241/47
3,457,047 A * 7/1969 Hachiro et al. ..... 422/198
5,067,661 A * 11/1991 Eide ..... 241/55
2008/0245913 A1 * 10/2008 Waznys et al. ..... 241/188.1

FOREIGN PATENT DOCUMENTS

DE 197 14 075 8/1998
DE 197 140 75 10/1998
DE 20 2010 008 197 3/2011

* cited by examiner

*Primary Examiner* — Faye Francis
(74) *Attorney, Agent, or Firm* — Harness, Dickey & Pierce, P.L.C.

(57) ABSTRACT

A device for mechanical separation of material conglomerates includes a separating chamber with a feed side and a discharge side, where the separating chamber is surrounded by a cylindrical separating chamber wall and has at least two consecutive sections, in each of which at least one rotor with impact tools, wherein the rotors have a rotor casing, the radius of which increases towards the discharge side, wherein the difference between the radius of the rotor casing and the radius of the separating chamber wall decreases from the feed side towards the discharge side, the directions of rotation of the rotor in the section facing the discharge side and the rotor of the section which lies ahead in the direction of the material flow are counter-rotating, and the rotational velocity of the rotors in the sections from the feed side towards the discharge side of the separating chamber, increases.

20 Claims, 4 Drawing Sheets

DEVICE FOR MECHANICAL SEPARATION OF MATERIAL CONGLOMERATES FROM MATERIALS OF DIFFERENT DENSITY AND/OR CONSISTENCY

BACKGROUND

In the slags and ashes of thermal waste reclamation as well as in the slags of metal production, there are numerous ferrous and nonferrous metals which are integrated in their native form in mineral slags or which are heavily scaled. These metals can only be recovered efficiently from the material conglomerates, if these metals are released or separated from their composites/scale formations such that they can be subsequently segregated from the material flow by magnets or nonferrous metal separators.

According to prior art such slags are fragmentized with traditional hammer and impact mills and are subsequently fed into magnetic and nonferrous metal separators.

With hammer and impact mills, the decomposition and the reclamation of metals with a particle size of more than 20 mm is possible as well as efficient. For the decomposition of smaller metal particles with these mills, it would be necessary to adjust very small gap separations, such as less than 20 mm, which would then result in a significant increase in grind crushing at the expense of impact crushing. The consequence of this grind crushing would be that soft nonferrous metals would be comminuted to such an extent that they could no longer be separated by means of a nonferrous metal separator. For this reason, the reclamation of small metal particles which are present in slags in their native form, using agglomerate breakers from prior art, is possible only to a limited extent.

SUMMARY

The invention relates to a device (10) for mechanical separation of material conglomerates from materials with different density and/or consistency, comprising a separating chamber (22, 24, 26) with a feed side (34) and a discharge side (38), which separating chamber is surrounded by a cylindrical separating chamber wall (12) and has at least two consecutive sections (22, 24, 26) in the axial direction in each of which at least one rotor (16, 18, 20) with impact tools (42, 44, 46, 48, 50, 52) which extend radially into the separating chamber is arranged, with the following features:

- the rotors have in the consecutive sections from the feed side to the discharge side a rotor casing (17, 19, 21), the radius of which increases towards the discharge side,
- the difference between the radius of the rotor casing and the radius of the separating chamber wall decreases from the feed side towards the discharge side,
- the directions of rotation of the rotor (20) in the section (26) facing the discharge side and the rotor (18) of the section (24) which lies ahead in the direction of the material flow are counter-rotating, and
- the rotational velocity of the rotors in the sections (22, 24, 26) from the feed side towards the discharge side of the separating chamber, increases.

With such device, the highest impact velocities of material conglomerates to be separated on impact tools can be achieved, which result in crushing the material conglomerates with only a small pulverizing effect.

The object of the invention therefore is to create a device with which the mechanical decomposition and/or the separation of small and extremely small native metal particles incorporated in the slags is possible. The invention is also intended to be usable for other material conglomerates from materials of different density and/or consistency.

This object is accomplished by a device with the features of claim 1. Advantageous developments of the invention are subject of the sub-claims.

BRIEF DESCRIPTION OF THE DRAWINGS

The invention may take physical form in certain parts and arrangement of parts, at least one embodiment of which will be described in detail in this specification and illustrated in the accompanying drawings which form a part hereof and wherein.

BRIEF DESCRIPTION

Figure 1:
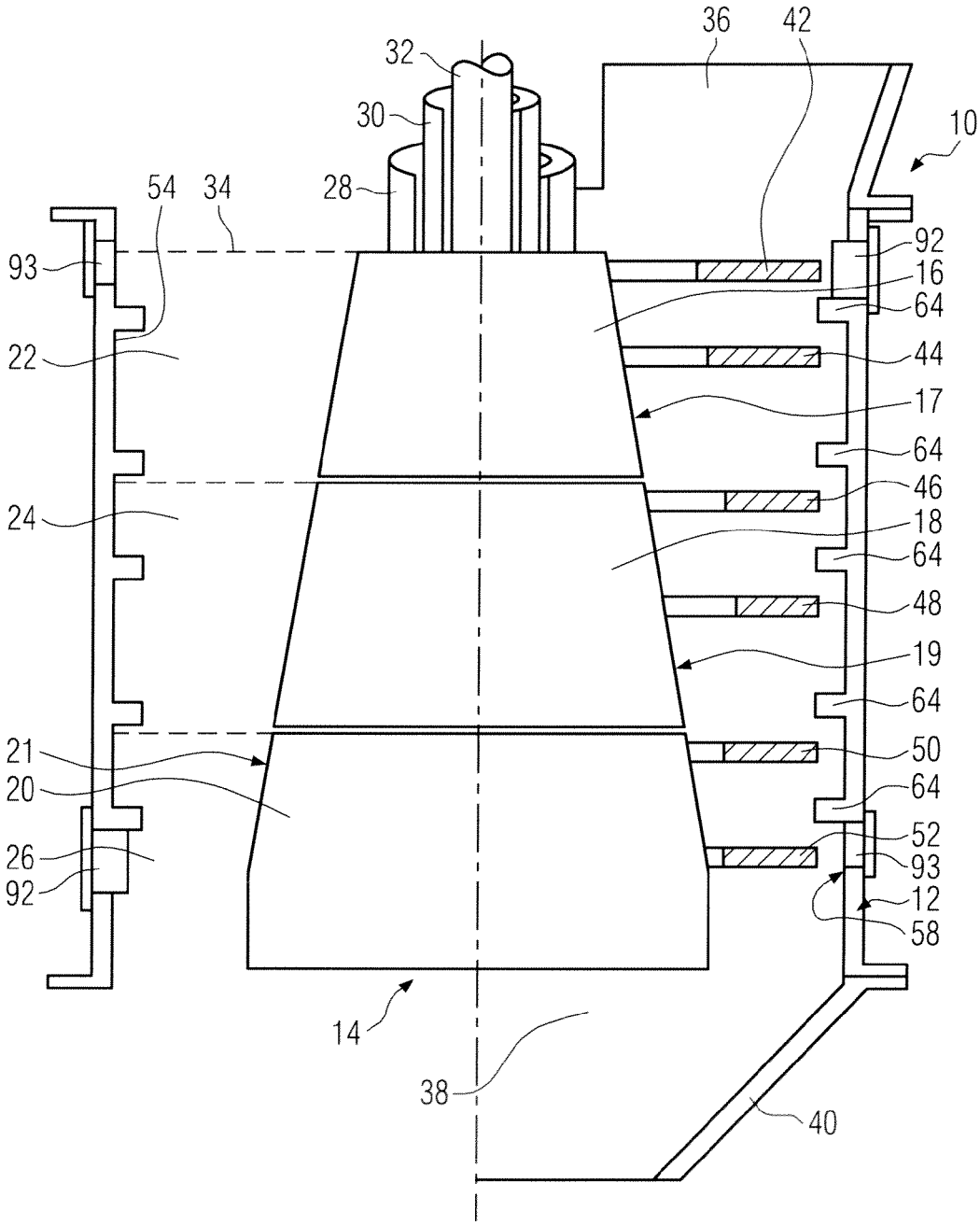
FIG. 1 is a side elevation of a mechanical separating device of the invention with three rotors.

The device as taught by the invention has a separating chamber with a feed side and a discharge side. The separating chamber is surrounded by a cylindrical separating chamber wall, which is normally aligned vertically, wherein the feed side is on the top and the discharge side is on the bottom. But in principle it is also possible to arrange the axis horizontally, if the system is used for the reclamation of only very small material conglomerates by means of horizontal airflow. Otherwise, in the vertical arrangement, the material feed is done gravimetrically from the top.

In the direction of the cylinder axis, the separating chamber has at least two, preferably three consecutive sections. In each of the three sections, there is at least one rotor each, on which impact tools are arranged, which extend radially into the separating chamber at least during the operation of the device. If chains are used as impact tools, these extend into the separating chamber radially only, if the rotor rotates with the respective rotational speed. The impact tools serve, perhaps only in conjunction with baffle plates on the separating chamber wall to be described later, for crushing the material conglomerates in a manner still to be described in detail.

The rotors have in their successive sections a rotor casing that is conically shaped, the radius of which increases from the feed side towards the discharge side. In this manner it can be achieved that the supplied material conglomerates are positioned further towards the outside in the radial direction as they increasingly advance towards the outside in the separating chamber, where the absolute velocity of the impact tools is much higher than in the radial area on the inside. The increase in the diameter of the cone can be continuously like a cone or in steps, such as in the form of a cascade. The radius of the separating chamber wall can either stay the same, or can preferably increase from the feed side towards the discharge side, which will also result in that the absolute velocities of the particles in the separating chamber increase with increasing distance completed in the separating chamber. In principle, the radius of the separating chamber w all can even decrease; this can possibly be problematic, however, because of the increasing risk of plugging. If the radius of the separating chamber wall increases towards the bottom, then the increase can be continuous or in steps. In each case, the radius of the rotor casing and the radius of the separating chamber wall will for this purpose be adjusted in the axial direction of the separating chamber such, that the difference between these two radii decreases from the feed side towards the discharge side. This will achieve that the volume of the separating chamber becomes smaller with the increasing axial advance of the material in the separating chamber, which results in increasing the particle density and thus in increasing the reciprocal impacts and the impacts of the particles against the impact tools or baffle plates.

In addition to that, the direction of rotation of the rotors in the respective adjacent sections is preferably counter-rotational. In this manner it is achieved that the particles which are accelerated by the impact tools in one section will impact head-on against the counter-rotating impact tools in the next section. The impact velocity thus is the sum of the particle velocity and the velocity of the impact tools. This will achieve an extremely high impact velocity of the metal particles on the impact tools and/or baffle plates on the separating chamber wall, which results in crushing the material conglomerates, insofar as there are materials of different density and/or consistency, such as elasticity, inside. The invention teaches that ultimately the rotational velocity of the rotors in the sections from the feed side towards the discharge side of the separating chamber, increases. In this manner it can be achieved that the impact velocities of the material conglomerates increases in the range of increasing particle density in the direction towards the discharge side, because there also the rotational velocities of the rotors and therefore the absolute velocities of the impact tools increase.

The combination of the technical features explained above thus results in that on the one hand, the velocity of the material conglomerates increases greatly towards the discharge side, and at the same time the particle density, but is intended to result ultimately in that the material conglomerates in the last section before the outlet of the separating chamber impact against baffle plates or impact tools and with velocities in excess of 200 m/s, which results in bursting apart the material conglomerates, without that these are being pulverized as in the prior art. The size of the metal particles contained in the material conglomerates is therefore not reduced.

The device of the invention therefore permits the separation of iron or nonferrous metals from slags or scale formations, for example, which is hardly possible using the known devices from the prior art. In this process, the invention utilizes a design which produces maximization of the impact energy of the material conglomerates to be decomposed on the impact tools and/or the baffle plates in the separating chamber, without the metal parts themselves being fragmented. It is consequently possible to separate even the smallest metal particles in slags still in an economically sensible manner with the invention. With the invention therefore the highest impact velocities of material conglomerates to be separated on impact tools can be achieved, which results in crushing the material conglomerates with only a small pulverizing effect.

Whilst it is basically possible to use one drive for the rotors in the three sections and to provide the counter-rotating direction of rotation and different rotational speeds by means of gear units, it is preferable that the rotor in each section has its own drive, which can be controlled and/or driven independently of the rotors in the other sections. In this manner, the rotational speeds can be adapted to different material conglomerates to be separated, which would be possible only with extra expense with just one drive for all rotors.

The rotor casing is designed preferably like a truncated cone, which results in that the material conglomerates and metal particles are transferred into the radial area of the separating chamber which is further towards the outside, without reducing their rate of fall substantially. The rotor casings in the successive sections will then preferably form a truncated cone in which the diameter of the truncated cones in the sections facing each other corresponds in each case and continues with increasing radius towards the discharge side. In this manner, a transfer of the supplied metal particles and material conglomerates can occur in the entire separating chamber into the radially outer area, without appreciably reducing the material throughput in the axial direction of the separating chamber. It is also possible in principle, however, to realize an increase in the diameter of the rotor casing in stages, wherein then in each section preferably one or several axial areas with a constant diameter of the rotor casing are developed, which are followed by subsequent stages of areas with larger diameters. This version has the disadvantage that the axial material throughput through the separating chamber is impeded more.

The impact tools are preferably held in receptacles developed on the rotor so that they can be replaced easily.

The rotor casing is preferably designed in the same manner from several replaceable rotor casing elements mounted on the rotor. During the transfer of the material particles into the radially outer area of the separating chamber, the rotor casing is subjected to a certain amount of wear, so that merely replacing the rotor casing elements is significantly more cost-effective than having to replace the entire rotor.

The invention is subsequently described by means of a separating chamber with three sections. It must be made clear, however, that the invention can also function in the same manner with two sections or also four or more sections. The first section facing the feed side will hereafter be named the pretreatment chamber. A second section follows this pretreatment chamber, which will be named acceleration chamber. The third section, which is facing the discharge side, will be named the high velocity impact chamber.

In an advantageous development of the invention, in the first and/or second and/or third section, i.e. in the pretreatment chamber, in the acceleration chamber and/or in the high velocity impact chamber, two axially offset receptacles for the impact tools are provided. In this manner, it is possible to adjust the number of impact tools per section of the separating chamber over wide ranges, which in the first two sections entails an improvement in the acceleration of the particles and the material conglomerates and in the third section an increase in the probability of a collision of the material conglomerate on an impact tool.

The rotor casing preferably has at least and preferably in the second section lifting bars, which extend into the separating chamber axially and radially. These lifting bars carry along material particles which move along radially further inside in the area of the rotor casing and accelerate them in the area of the separating chamber which is radially outside, so that this material can be crushed more effectively by the impact tools of the high velocity impact chamber, since the absolute velocity of the impact tools in the area which is radially outside is higher than in the area that is further inside radially.

Just this feature is useful for the fundamental idea of the invention, to increase the kinetic energy of all material particles in the separating chamber if possible to such an extent that an impact of the material particles or material conglomerates with impact elements or baffle plates is achieved with a certain velocity, which is in the range of approximately 200 m/s. The applicant has discovered that it is relatively certain that such impact velocity will produce the crushing of the material conglomerates, without fragmenting the metal components themselves. The upper limit of the impact velocity is practically the velocity of sound, which represents a certain practical physical limit for the absolute velocity of the impact elements, as it were.

In order to increase the number of collisions of material particles and/or material conglomerates in the separating chamber, baffle plates can be developed on the separating chamber wall, which extend axially and radially to the inside. After the acceleration by the impact tools, material particles can impact against these baffle plates and can then break up.

Preferably more impact tools are arranged in a section that follows the feed direction of the material than in the section arranged before it. This has the advantage that the number of collisions of material and impact tool is displaced towards a section in which the impact tools have a higher impact velocity. It can thus be possible that the number of impact tools in the pretreatment chamber is even lower, for example, since the object of this chamber is to convey the material particles radially towards the outside, so that they can get there into the sphere of action of the impact tools of the subsequent acceleration chamber, in which already more impact tools are arranged than in the pretreatment chamber. Moreover, in the pretreatment chamber, lifting bars can in addition be developed on the rotor casing to realize an effective transfer of the material particles in the area which is radially on the outside.

In the acceleration chamber, which follows the pretreatment chamber in the feed direction of the material, clearly more impact tools are arranged than in the pretreatment chamber. These impact tools are utilized to accelerate the material particles which are present with higher density to the outside and to the bottom in the direction of the high velocity impact chamber. The rotor casing of the acceleration chamber can also have lifting bars in order to transfer the particles into the area positioned radially on the outside, where they are accelerated by the more numerous impact tools in the acceleration chamber greatly in the direction to the high velocity impact chamber.

In the high velocity impact chamber, i.e. in the third section, most of the impact tools are arranged, which are utilized to crush the greatly increased material particle density in this section of the separating chamber with a high degree of probability, due to the increasing radius of the rotor casing. The numerous impact tools in the high velocity impact chamber preferably rotate at the maximum rotational velocity, which is preferably selected such that it is about 200 m/s but less than 300 m/s, i.e. below the velocity of sound, in the outside area on the outside edge of the impact tools.

The increasing number of impact tools in the successive sections as also the increasing rotational speed in the successive sections in conjunction with the counter-rotating direction of rotation therefore results in all transition zones from one section to the next in order to maximize the impact energy, which produces an effective mechanical decomposition of the material conglomerates. The material conglomerates which are disintegrated into the individual constituents can be separated from each other later after the discharge from the separating chamber in the actually known segregation or separation chambers, such as cyclones, magnetic separators, etc.

To realize the maximization of the impact velocity of the metal particles in the separating chamber as well as the probability of an impact of the metal particle onto an impact tool, it has proven to be advantageous to adjust the ratio of the rotational speed of the rotors between a subsequent section and the section arranged before it in the direction of feed between 1.5 and 5, in particular between 2 and 4.

Then, the absolute velocities of the rotors are then to be preferably adjusted such that the absolute velocity of the outside edge of the impact tools in the third section is between 100 and 300 m/s, preferably between 200 and 300 m/s.

The ratio of the radii of the rotor casing to the separating chamber wall is preferably between 0.25 and 0.6 in the first section, between 0.4 and 0.7 in the second section, and between 0.5 and 0.8 in the third section. Such ratio of the radii, on the one hand, achieves an effective transfer of the material particles in the areas that lie radially outside in conjunction with a corresponding increase of the density of the metal particles. Whereas on the other hand, the flow of material will not be too heavily affected by the expansion of the rotor casing, because the radius of the separating chamber wall does not increase at the same rate as the radius of the rotor casing. This ultimately results in an increase of the particle density and an increase in the impact energy, since in these radial widths, the absolute velocities of the impact tools are higher than in the areas which are further inside radially.

The diameter of the rotor casing can increase from the top to the bottom from 500 mm to 1400 mm in a separating chamber, for example. At the same time, the diameter of the separating chamber wall can increase from 1200 mm to 1900 mm from top to bottom, or it can remain constant in a range from 1700 to 1900 mm. The distance between the rotor casing and the separating wall therefore decreases towards the discharge side. This decrease exists on average at least over a certain axial distance. The distance between the rotor casing and the separating wall can obviously increase briefly towards the outlet of the separating chamber, if a cascaded expansion stage currently exists in the separating wall, for example. In this example, the rotor velocities (rotational speeds) in the three sections can be 600, 1000, and 1500 RPM from top to bottom, wherein the rotors in the first and the second section rotate in the same direction and in the second and third section rotate in the opposite direction. The absolute velocity of the impact tools in the outside area of the third section (high velocity impact chamber) is thus more than 140 m/s. In this way, in conjunction with the counter-acceleration of the particles in the pretreatment chamber and the acceleration chamber, impact speeds of more than 200 m/s can be realized.

In this manner, the impact velocity and therefore the impact energy of the metal particles when impacting on the impact tools and/or baffle plates inside the separating chamber are maximized within the physically feasible and sensible limits.

The impact tools are formed by chains and/or baffles, as is actually known and as is demonstrated by DE 10 2005 046 207, for example.

The device as taught by the invention preferably has a feed hopper on the inlet side and a discharge hopper on the outlet side, by means of which the mechanically decomposed material can be directed onto a conveyor belt or a separator device, for example.

The invention is obviously not limited to the application of metal particles in slags, but can be used for all types of metal conglomerates consisting of materials of different density or elasticity.

In case where the rotor of each section has its own drive, the rotors can be separately driven by drives and by means of reciprocal concentric shafts arranged on one end of the separating chamber, or the drives can be radially inside of the rotor casings of the respective rotors, in particular in the form of external rotor motors.

The separating wall as well as the impact tools and the rotor casing preferably consist of hard impact resistance materials such as metal or ceramic/metal composite materials.

It is not imperative that the number of rotors per section must be one (1), but it is also possible that two or more rotors can be provided in one section in an axial sequence. The invention is moreover not limited to the design of two sections, but the invention can in principle be realized with three or more successive sections, such as with four or five axially successive sections.

The chamber wall can have several annular peripheral protrusions to divert the material which drops along the chamber wall to the bottom into the direction of the rotor. In this manner, the material will be brought into the sphere of action of the impact tools and therefore be effectively provided for crushing.

FIG. 1 shows a sectional longitudinal section of a device 10 as taught by the invention for mechanical separation of material conglomerates from materials of different density and/or consistency. The end device 10 has a cylindrical separating wall 12, which is arranged perpendicular and the diameter of which is constant. Said diameter can however also increase from the top to the bottom, for example. A rotor arrangement 14 is concentrically arranged in the cylindrical separating wall 12, which consists of three rotors 16, 18, 20, arranged on top of each other, which can be driven separately.

Three sections 22, 24, 26 of a separating chamber are formed between these rotors 16, 18, 20 and the corresponding axial sections of the cylindrical separating wall 12. The top first section 24 of the separating chamber can be designated as pretreatment chamber, and the second section 24 which lies in the center can be designated as acceleration chamber, and the last bottom section 26 before the discharge side can be designated the high velocity impact chamber.

The rotors 16, 18, 20 can be separately driven by the associated shafts 28, 30, 32. These shafts are respectively connected with drives (not shown) above the separating device 10. The separating chamber forms a feed side 34 with a feed hopper 36 on its top end for the product material to be fed that is to be separated.

At the bottom end of the separating chamber formed by the sections 22, 24, 26, the discharge side 38 with a discharge hopper 40 is located, in order to transfer the crushed and mechanically decomposed bulk material to a belt conveyor, for example.

The rotors 16, 18, 20 have a conical rotor casing 17, 19, 21 concentrically to the rotor, the diameter of which increases from top to bottom. In this manner, the rotor arrangement 14 has the overall shape of a truncated cone. For reasons of clarity, in the following the individual rotors and sections in their arrangement of the direction of material flow are numbered from the top to the bottom. The first rotor 16 has two rows 42, 44 of impact tools which are axially offset to one another across the circumference, and which are connected with the rotors 16 in a manner which will be described in greater detail. In the same manner, the second rotor 18 has a third and fourth row 46, 48 of impact tools, which are likewise axially offset to one another. Finally, also the third rotor 20 has two rows 50, 52 of impact tools on the discharge side which are axially offset to one another.

These impact tools are chains or metal rods, for example, which have a hard metal impact edge on their front side in the direction of rotation.

While the rotor arrangement 14 increases continuously like a truncated cone from the top to the bottom, i.e. from an inlet side to the discharge side, the diameter of the cylindrical separating wall 12 is constant.

In the axial direction, several successive annular peripheral protrusions 64 are developed on the chamber wall 12. These protrusions serve to divert material which drops down along the chamber wall in the direction of the rotor, and therefore provide it effectively for crushing.

These protrusions can (in a manner not shown) be beveled from outside on the top to the bottom inside in order to achieve an improved guide effect. If the radius of the chamber wall increases from top to bottom, no annular protrusions are necessary to achieve effective crushing of the material, because in this case the material drops away from the wall in direction of the rotor casing. The inside diameter of the separating chamber wall 12 can be 1760 mm, for example, while the inside diameter of the annular peripheral protrusions is 1600 mm. The top diameter of the rotor casing can be 60 mm, for example, while the bottom diameter on the discharge side can be 1120 mm, so that the gap between the separating chamber wall and the rotor casing decreases from the feed side towards the discharge side from 580 mm to 320 mm.

This fact that the distance between the rotor casing 17, 19, 21 and the corresponding section of the separating chamber wall 12 decreases from top to bottom and is radially displaced towards the outside, is a significant aspect of the arrangement shown in FIG. 1, which assists with the effective decomposition of the material conglomerates.

The consequence is that on the one hand, the volume of the separating chamber is reduced towards the bottom, as a result of which the density of the material in the separating chamber increases, and that in addition the material is transferred into the radial area of the separating device 10 which is further outside, where the absolute velocity of the impact tools 41, 44, 46, 48, 50, 52 increases.

Furthermore, the direction of rotation of the second rotor 18 and the third rotor 20, i.e. the rotor before the discharge side 38 is counter-rotational, so that the material accelerated by the impact tools 46, 48 of the second rotor 18 impact on the counter-rotating impact tools 50, 52 of the third rotor 20, as a result of which the velocity of the material particles as well as the velocity of the impact tools add up based on the rotation of the third rotor 20. This can also produce impact speeds of the material particles on the impact tools of more than 200 m/s which results in a relatively secure decomposition of material composites consisting of materials of different density and/or consistency.

The three rotors 16, 18, 20 in the embodiment are driven by means of concentric shafts 28, 30, 32 by means of drives from the top. Alternatively, the shafts can also extend towards the discharge side, however. It is equally possible to arrange the drives themselves radially inside of the rotor casings 17, 19, 21 assigned to the corresponding rotors 16, 18, 20, so that extending the drive shafts out of the separating device 10 is no longer necessary.

It must furthermore be clarified that instead of the three axial sections 20, 20 to 24 in the embodiment off FIG. 1, also two or four and more sections can be used. Equally, the provision of a feed hopper and/or a discharge hopper, is optional. Furthermore the question whether the increase in diameter of the rotor casings 17, 19, 21 and optionally of the separating chamber wall 12 must be continuous or in stages, is not important for the invention.

Figure 2:
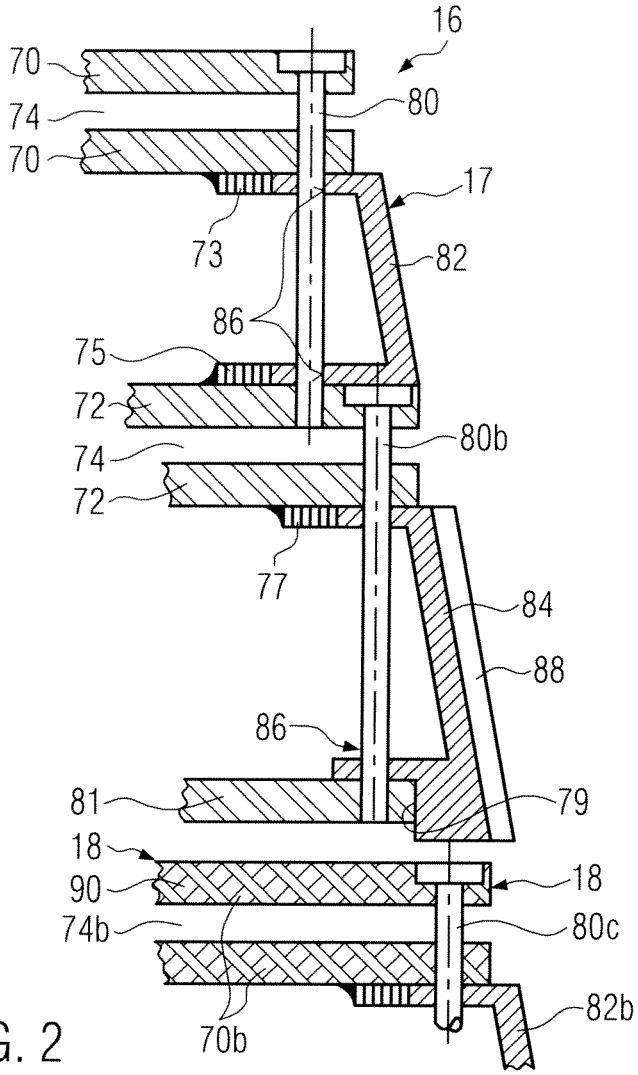
FIG. 2 is a sectional detail of the rotor from FIG. 1.
Figure 4:
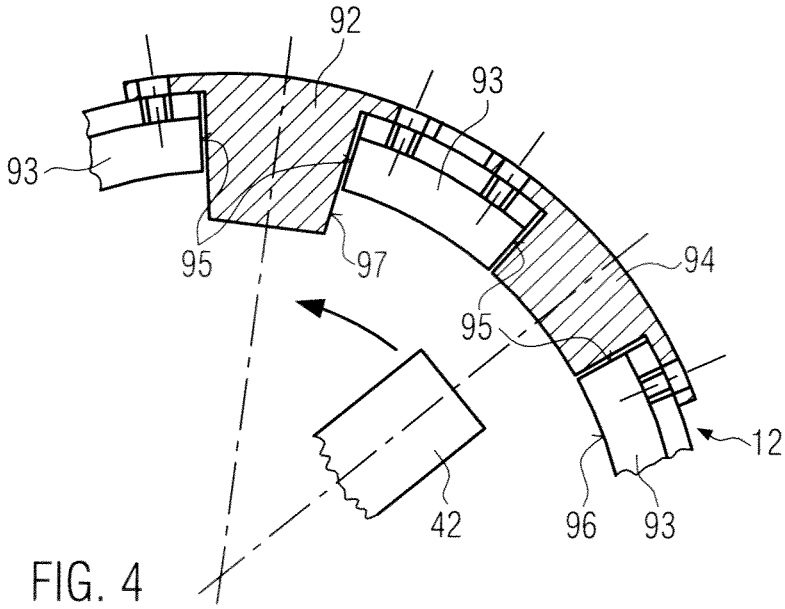
FIG. 4 is a detail from FIG. 1.

FIG. 2 shows an example of a detail of the top first rotor 16 from FIG. 1. The first rotor 16 contains three disc holders connected torque-proof to the assigned rotor shaft 28 (not shown) and which rotate concentrically to the rotor axis. The upper disc holder 70 has a smaller outside diameter than the disc holder 72 and 81 located below it. Cutouts 74 are provided in the outer periphery of the top two disc holders 70, 72, in which the first links 76, 78 of impact chains 44, 46 are inserted (FIG. 4). All disc holders 70, 72, 81 of the rotor 16 have vertical bores into which bolts 80, 80*b* can be inserted.

Rotor 16 casing elements 82, 84 are arranged between each two disc holders 70, 72 and 72, 81, which likewise have a vertical bore 86, which are oriented in-line with the bores of the disc holders 70, 72. Limit stops 73, 75 which are facing the rotor casing elements 82, 84, are developed on the bottom side of the upper disc holder 70 and on the upper side of the disc holder 72 which lies under it on which the side of horizontal support walls of the casing elements 82, 84 facing the rotor is finally positioned. In this manner, the rotor casing elements are centered and supported on the rotor in the correct position. The rotor casing elements 82, 84 are then fixed on the rotor 16 in the supported position by means of bolts 80, 80*b*. If the rotor casing elements 82, 84 have to be replaced, this can be easily done by removing the bolts 80, 80*b* and by replacing the corresponding elements.

The rotor casing element 84 which is further below has a lifting bar 88, which extends radially and axially from the truncated cone exterior surface of the rotor casing element 84 to the outside. The lifting bar 88 is provided for the purpose of accelerating the material components which get into the area of the rotor casing 17 radially towards the outside, in order to transfer them there into the area of higher velocities of the impact tools. These lifting bars 88 are particularly provided also on the rotor casing elements of the second rotor 18. The lower rotor casing element 84 in addition has an overlapping outside edge 79, which is supported against the disc holder and thus fixes the rotor casing elements on the rotor in a similar manner like the limit stops 73, 75, 77 in its position, which is then fixed by the bolts 80, 80*b*.

The Figure furthermore shows a disc holder 70*b* of the second rotor 18 of the rotor arrangement 14 from FIG. 1. Because of the larger diameter of this second rotor 18 compared with the diameter of the first rotor 16, the holder 74*b* for the impact elements 46 and the bores for the bolt 80*c* are radially offset further towards the outside.

Figure 3A:
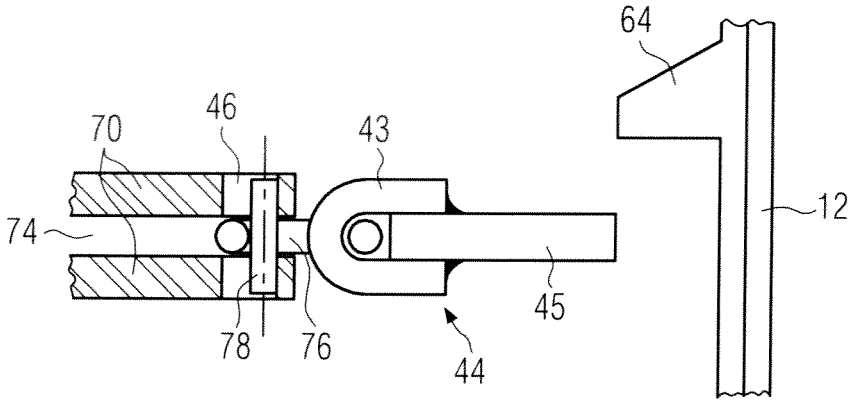
FIGS. 3A and B are a sectional view and horizontal projection of a detail of the suspension mount of the impact tools from FIG. 1.
Figure 3B:
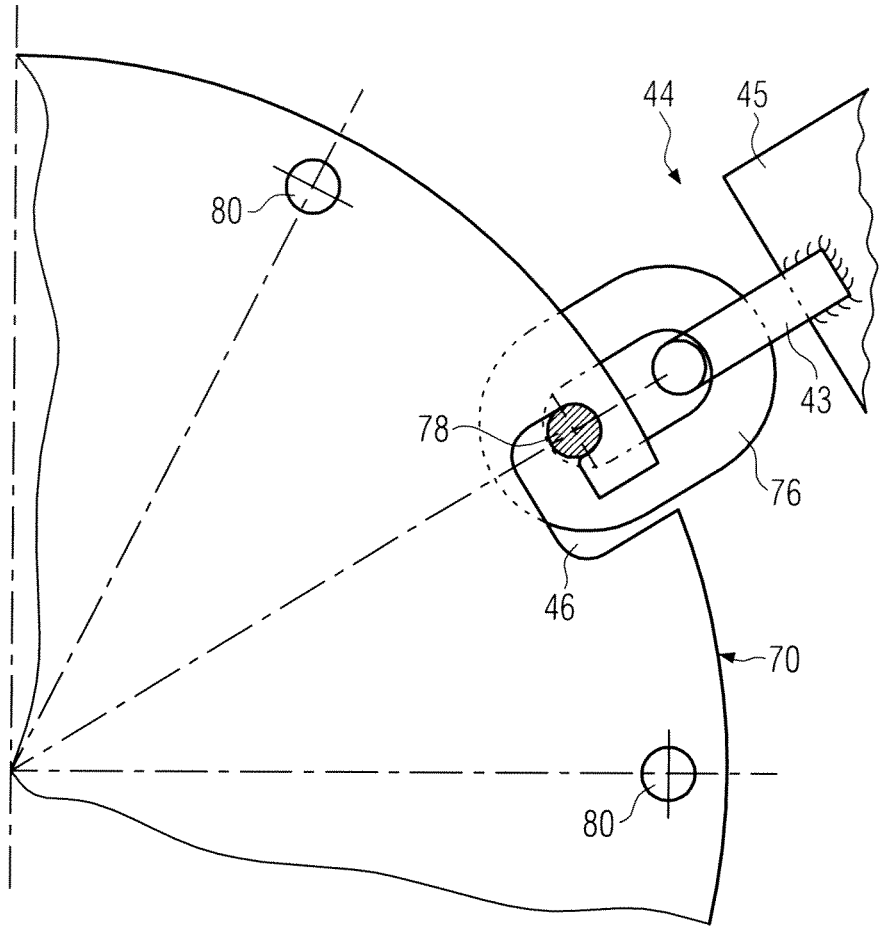

The FIGS. 3*a* and *b* show the connection between the disc holder 70 and the impact tools 42, 44, 46, 48, 50, 52 developed as an impact chain. The impact chain 42, 44, 46, 48, 50, 52 consists of a first chain-link 76 facing the rotor, into which a vertical bolt 78 is welded. A second semi-open chain-link 43 engages into the first chain-link 76 into which an impact bolt 45 made of a highly-resistant steel is welded. Several (e.g. up to 8) milled-out pockets 46, distributed around the perimeter, are located in the disc holders 70, 72, 81 (see particularly FIG. 3*b*) into which the impact chains 42, 44, 46, 48, 50, 52 with their bolts 78 will simply be hooked in. FIG. 3 in addition shows an annular peripheral protrusion 64 of the separating chamber wall 12, which is positioned opposite of the impact tool 44. It can be seen, that the fed-in material gets from the protrusion 64 into the area of the impact tool.

FIG. 4 shows a detail from FIG. 1, which clarifies how an impact element 92 is attached in the separating chamber wall 12. The impact element has an impact surface 97 which serves as the impingement surface for the accelerated material from the impact tools 42, and which results in the decomposition of the material conglomerates there. The conglomerates obviously also decompose on the impact tools themselves. The rotational direction of the rotor is indicated with an arrow.

The impact elements 92 on the cylindrical separating wall 12 form "teeth" which protrude into the rotor, in that they extend axially and radially towards the inside. The impact elements 92 can be inserted into pockets 95 provided for this purpose, which are distributed around the periphery of the separating chamber wall 12. Therefore 4 to 8 pockets 95 can be distributed around the perimeter, for example. The impact elements 92 are inserted into these pockets 95 from the outside and are bolted to the separating chamber wall on the outside. The side 97 of the impact element 92 which is opposite to the direction of rotation and protrudes into the separating chamber, forms the impact surface. When a smooth cylindrical separating wall, i.e. without any impact surfaces, is desired, a so-called placeholder 94 is used. The placeholders 94 have the same thickness as the separating wall chamber 12, but include their wear lining 93, by which they are in alignment with the inside 96 of the separating chamber wall, which results in a continuous smooth cylindrical inside 96 of the separating chamber wall 12. The impact elements 92 on the other hand project into the separating chamber.

Figure 5:
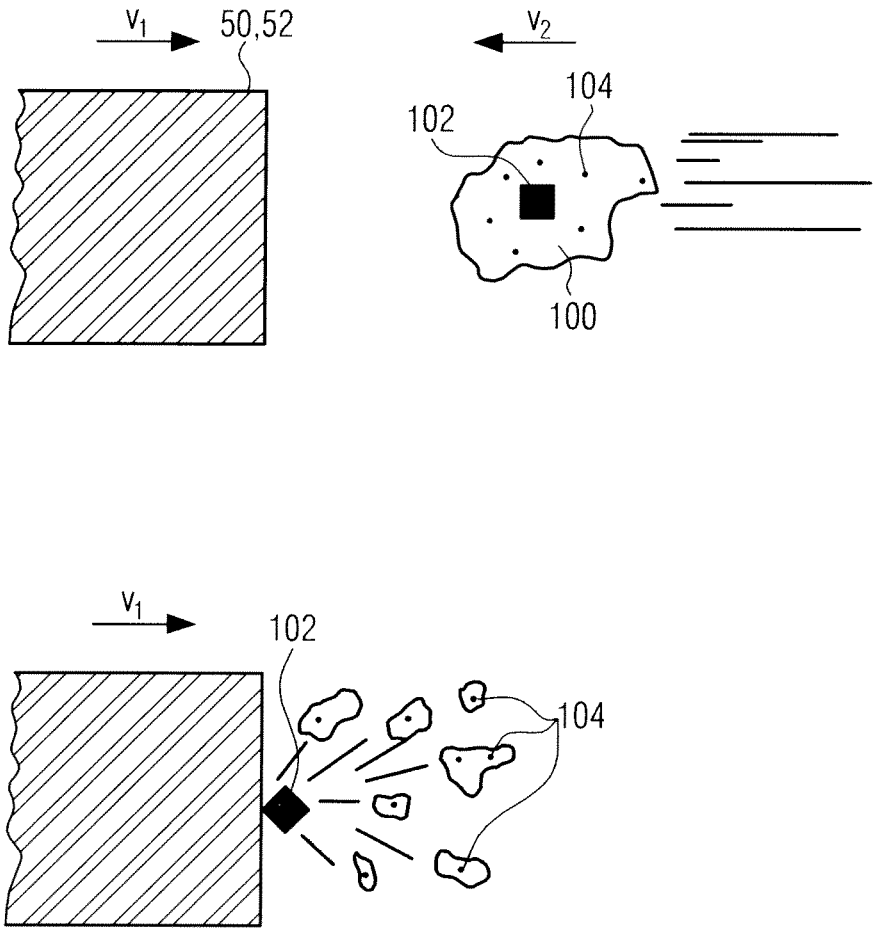
FIG. 5 is a schematic illustration of the principle of the mechanical decomposition of material conglomerates as taught by the present invention.

FIG. 5 elucidates the basic mode of action of the separating device as taught by the present invention.

The invention teaches that the material conglomerates 100 which consist of metal particles 102 and the slag residues 104 are accelerated by the impact tools of the separating device as taught by the invention. As a result, they gain a velocity $v_2$. In the next section 26 of the separating chamber, they then impact with high velocity against the impact tools 50, 52 which rotate in the opposite direction, by which the velocity $v_2$ of the material conglomerates 100 and the velocity $v_1$ of the impact tools 50, 52 add up during the impact, which results in a secure bursting apart of the material conglomerates into their individual components 102, 104 during the impact. It is thus possible to achieve impact speeds of 200 m/s and more by means of the invention. The energy released in this process results in a secure splitting up of material conglomerates that are even firmly baked together.

The invention is not limited to the present embodiment but variations within the scope of the subsequent Claims are possible.

In particular, the number and the distribution of the impact tools can deviate from the illustrated example. It is possible to use different impact tools such as chains and baffles. Very many more impact tools can be distributed around the perimeter in the rows 50 and 52 of the impact tools in the third section 26 of the separating chamber, than in the first section 22. This results in an increased probability of collisions in the area of the third section, which can also be designated as high velocity impact chamber.

This separating chamber wall can have a compartment which can be opened so that it can be used for access to the separating chamber to perform maintenance work, for example. The replacement of parts subject to wear and tear, such as the wear lining 93, the impact tools 42, 44, 46, 48, 50, 52 on the rotor casing elements 82, 84 can therefore be very much simplified.

Furthermore, notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

Having thus described the invention, it is now claimed:

1. A device for mechanical separation of material conglomerates from materials with different density and/or consistency, comprising:

a separating chamber with a feed side; and, a discharge side, where said separating chamber is surrounded by a cylindrical separating chamber wall and has at least two consecutive sections in the axial direction, in each of which at least one rotor has impact tools which extend radially into the separating chamber, wherein the rotors have, in the consecutive sections from the feed side to the discharge side, a rotor casing, the radius of which increases towards the discharge side, wherein the difference between the radius of the rotor casing and the radius of the separating chamber wall decreases from the feed side towards the discharge side, the directions of rotation of the rotor in the section facing the discharge side and the rotor of the section which lies ahead in the direction of the material flow are counter-rotating, and the rotational velocity of the rotors in the sections from the feed side towards the discharge side of the separating chamber, increases.

2. The device according to claim 1, wherein the rotor of each section of the separating chamber has its own drive, which can be driven and/or controlled independently of the rotors of the other sections.

3. The device according to claim 1, wherein the rotor casing is designed like a truncated cone.

4. The device according to claim 3, wherein the rotor casings of the rotors form a truncated cone in the consecutive sections of the separating chamber.

5. The device according to claim 2, wherein the axis of the separating chamber is perpendicular and with the feed side aligned to the top.

6. The device according to claim 1, wherein the impact tools are held in holders formed on the rotor, wherein the rotor is adapted to be replaceable.

7. The device according to claim 6, wherein in at least one section of the separating chamber two axially offset holders for the impact tools are provided.

8. The device according to claim 1, characterized in that the rotor casing is formed from several rotor casing elements held on the rotor, wherein the rotor is adapted to be replaceable.

9. The device according to claim 1, wherein the rotor casing has lifting bars at least in the second to last section in the direction of the material feed device, which extend into the separating chamber axially and radially.

10. The device according to claim 1, wherein in at least one section of the separating chamber impact surfaces are arranged which extends from the separating chamber wall towards the inside axially and radially.

11. The device according to claim 1, wherein in one section of the separating chamber, following in the feed direction of the material, has more impact tools than in the section of the separating chamber which is arranged before.

12. The device according to claim 1, wherein the ratio of the rotational speeds of the rotor between one section of the separating chamber and the section of the separating chamber arranged before in the direction of throughput of the material to be treated is between 1.5 and 5.

13. The device according to claim 11, wherein the rotational speed of the rotor in the last section of the separating chamber facing the outlet side is selected such that the absolute velocity of the outside edges of the impact tools is between 100 and 300 m/s.

14. The device according to claim 1, further comprises:

one feed hopper above the separating chamber and/or one discharge hopper below the separating chamber.

15. The device according to claim 8, wherein the ratio of the radii of the rotor casing to the separating chamber wall in the direction of the material feed on the feed side is between 0.25 and 0.6, and is between 0.5 and 0.8 on the discharge side.

16. The device according to claim 1, wherein the impact tools are formed by chains.

17. The device according to claim 1, wherein the diameter of the separating chamber wall increases from the feed side towards the discharge side.

18. The device of claim 12, wherein the ratio of the rotational speeds of the rotor between one section of the separating chamber and the section of the separating chamber arranged before in the direction of throughput of the material to be treated is between 2 and 4.

19. The device of claim 13, wherein the rotational speed of the rotor in the last section of the separating chamber facing the outlet side is selected such that the absolute velocity of the outside edges of the impact tools is between 130 and 200 m/s.

20. The device according to claim 1, wherein the impact tools are formed by baffles.

* * * * *